US009139402B2

(12) United States Patent
Dodge, IV

(10) Patent No.: US 9,139,402 B2
(45) Date of Patent: Sep. 22, 2015

(54) RETRACTABLE LOAD GUIDE

(75) Inventor: William Baldwin Dodge, IV, Roanoke, VA (US)

(73) Assignee: Altec Industries, Inc., Birmingham, AL (US)

( * ) Notice: Subject to any disclaimer, the term of this patent is extended or adjusted under 35 U.S.C. 154(b) by 779 days.

(21) Appl. No.: 13/401,042

(22) Filed: Feb. 21, 2012

(65) Prior Publication Data

US 2013/0216346 A1 Aug. 22, 2013

(51) Int. Cl.

| | |
|---|---|
| ***B66C 1/00*** | (2006.01) |
| ***B66C 1/44*** | (2006.01) |
| ***B66C 23/00*** | (2006.01) |
| ***B66C 1/68*** | (2006.01) |
| *B66C 1/58* | (2006.01) |
| *E04H 12/34* | (2006.01) |

(52) U.S. Cl.

CPC . *B66C 1/445* (2013.01); *B66C 1/68* (2013.01); *B66C 23/54* (2013.01); *B66C 1/585* (2013.01); *E04H 12/34* (2013.01)

(58) Field of Classification Search

CPC ..... B66C 1/585; B66C 23/54; B66C 1/445; B66C 1/68

USPC ..... 414/23, 731, 739, 741; 294/106, 198

See application file for complete search history.

(56) References Cited

U.S. PATENT DOCUMENTS

| | | | | |
|---|---|---|---|---|
| 3,036,372 | A * | 5/1962 | Vigneron | 29/237 |
| 3,071,405 | A | 1/1963 | Koehler | |
| 3,112,830 | A * | 12/1963 | Podlesak | 414/23 |
| 3,147,993 | A | 9/1964 | Broderson et al. | |
| 3,627,351 | A | 12/1971 | Zimmerman et al. | |
| 3,628,675 | A | 12/1971 | Balogh | |
| 3,631,991 | A | 1/1972 | Wacht et al. | |
| 3,933,261 | A | 1/1976 | Marostica et al. | |
| 3,933,389 | A | 1/1976 | Korbel | |
| 4,047,626 | A * | 9/1977 | Meisel, Jr. | 414/739 |
| 5,108,140 | A * | 4/1992 | Bartholet | 294/106 |
| 5,112,184 | A | 5/1992 | Tapper et al. | |
| 5,354,150 | A | 10/1994 | Canales | |
| 6,592,316 | B2 | 7/2003 | Hensler | |
| 6,755,604 | B1 * | 6/2004 | Schaeff | 414/700 |
| 7,137,616 | B2 | 11/2006 | Kysely | |
| 7,445,260 | B2 * | 11/2008 | Nihei et al. | 294/106 |
| 7,618,230 | B2 | 11/2009 | Sallen Rosello et al. | |
| 7,699,574 | B2 * | 4/2010 | Ferrara | 414/217 |

* cited by examiner

*Primary Examiner* — Scott Lowe

(74) *Attorney, Agent, or Firm* — Erise IP, P.A.

(57) ABSTRACT

A load guide for securing a load relative to a boom includes a base secured to the boom and a retractable arm assembly attached to the base. The base presents a front portion that is proximate a load supported by the boom. The arm assembly includes a pair of load-securing arms movably connected to the load guide base, each of the arms being movable between an operative position and a retracted position, wherein moving the arms from the operative position to the retracted position includes rotating each of the arms toward the other arm, and further includes translational movement of each of the arms away from the front portion of the load guide base.

20 Claims, 19 Drawing Sheets

RETRACTABLE LOAD GUIDE

BACKGROUND

1. Field

Embodiments of the present invention relate to load guides for utility vehicles and the like. More particularly, embodiments of the present invention relate to a load guide with a retractable portion that is moveable between an operative position and a retracted position.

2. Related Art

Construction and utility equipment may be equipped to lift, move, and place heavy loads. Such equipment may include a boom and a winch for engaging and moving heavy loads. By way of example, digger derricks and similar utility vehicles are used to set utility poles and the like by digging or drilling holes and then placing the utility poles in the holes. Digger derricks may include an auger to dig the hole, a winch to lift the pole, and a pole guide mounted on the boom to stabilize and guide the placement of the pole as the pole is positioned and then placed in the hole using the boom and winch.

Pole guides typically include a pair of arms or grapple tongs for selectively engaging and securing the pole as the pole is lifted using the winch. With the pole secured by the pole guide, the boom can then be moved to position the pole to be placed in the drilled hole. To effectively engage the pole, the arms protrude outward from the boom. The protruding arms may limit or obstruct movement of the boom when not in use or otherwise encumber use of the boom.

SUMMARY

A boom assembly in accordance with a first embodiment of the invention comprises a boom, a load guide base, and a pair of load-securing arms movably connected to the load guide base. The load guide base is secured to the boom and presents a front portion that is proximate a load supported by the boom. Each of the arms is movable between an operative position and a retracted position, wherein moving the arms from the operative position to the retracted position includes rotating each of the arms toward the other arm, and further includes translational movement of each of the arms away from the front portion of the load guide base.

A load guide in accordance with a second embodiment of the invention comprises a base including a load engaging front portion, and a first arm and a second arm each including a mounting portion and a load engaging portion. A first link element is pivotably attached to the base proximate a first end of the first link element and is pivotably attached to the mounting portion of the first arm proximate a second end of the first link element. A second link element is pivotably attached to the base proximate a first end of the second link element and is pivotably attached to the first arm proximate a second end of the second link element.

A third link element is pivotably attached to the base proximate a first end of the third link element and is pivotably attached to the mounting portion of the second arm proximate a second end of the third link element, the first and third link elements being mechanically entrained such that movement of one causes corresponding symmetric movement of the other. A fourth link element is pivotably attached to the base proximate a first end of the fourth link element and is pivotably attached to the second arm proximate a second end of the fourth link element.

An actuator induces movement of the third link element relative to the base, thereby causing the first arm and the second arm to move from an operative position to a retracted position, wherein moving the arms from the operative position to the retracted position includes rotating each of the arms toward the other arm, and further includes translational movement away from the front portion of the base.

A method of using a load guide with a retractable arm assembly in accordance with a third embodiment of the invention comprises moving a pair of arms of the arm assembly to an open position to receive a load supported by a boom, moving the pair of arms to an engaged position to engage and secure the load, and moving the pair of arms to a retracted position by rotating each of the arms toward the other arm and moving each of the arms away from a front portion of a load guide base, the load guide base being secured to the boom.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

Figure 1:
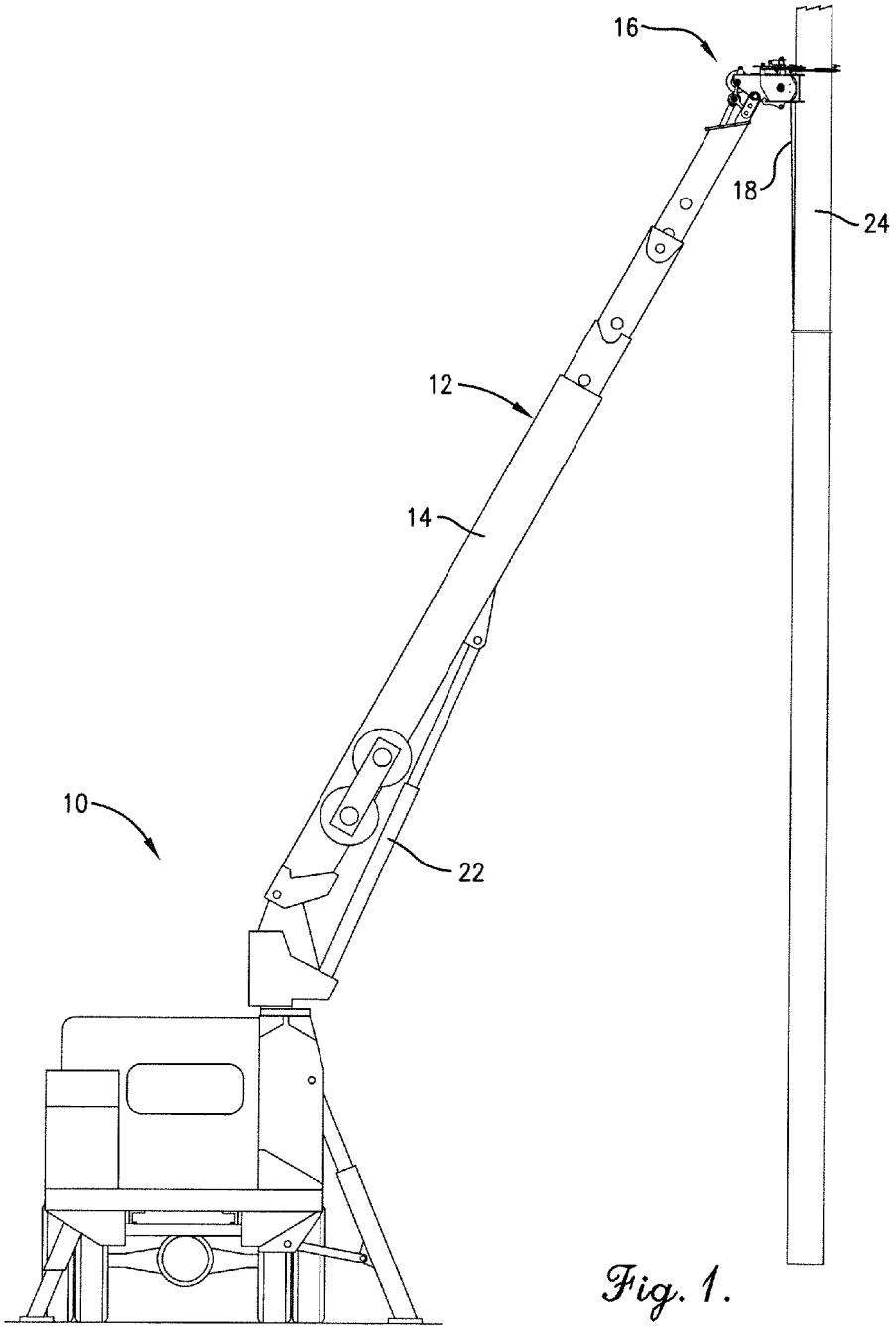
FIG. 1 is a rear elevational view of an exemplary utility vehicle equipped with a boom and a load guide mounted on the boom, the load guide shown engaging a load with a retractable arm assembly constructed according to an exemplary embodiment of the present invention, and including a retractable arm assembly.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etcetera described in one embodiment may also be included in other embodiments, but is not necessarily included. Thus, the present technology can include a variety of combinations and/or integrations of the embodiments described herein.

Turning now to the drawings, an exemplary utility vehicle 10 with a boom assembly 12 including a boom 14 and a load guide assembly 16 constructed according to an exemplary embodiment of the present invention is illustrated. The boom assembly 12 is mounted on the vehicle 10 to enable rotational and/or pivotal movement relative to a frame of the vehicle 10 and includes a loadline 18 for attaching to and lifting a load in a conventional manner. The illustrated boom 14 comprises a plurality of nested boom sections that may be telescopically extended and retracted and a piston and cylinder assembly 22 for pivoting the boom 14 relative to the vehicle 10. The vehicle 10 may further include additional implements or tools not depicted in the drawings, such as an auger attached to the boom for drilling a hole for utility pole placement.

The load guide assembly 16 is secured to a distal end of the boom 14 and is positioned to engage, secure, and stabilize a load 24 held by the loadline 18 and guide the load 24 into a desired position. By way of example, the load 24 may be a utility pole wherein the load guide assembly 16 engages and stabilizes the utility pole while the boom 14 lifts and positions the pole to be placed in a hole.

Figure 2:
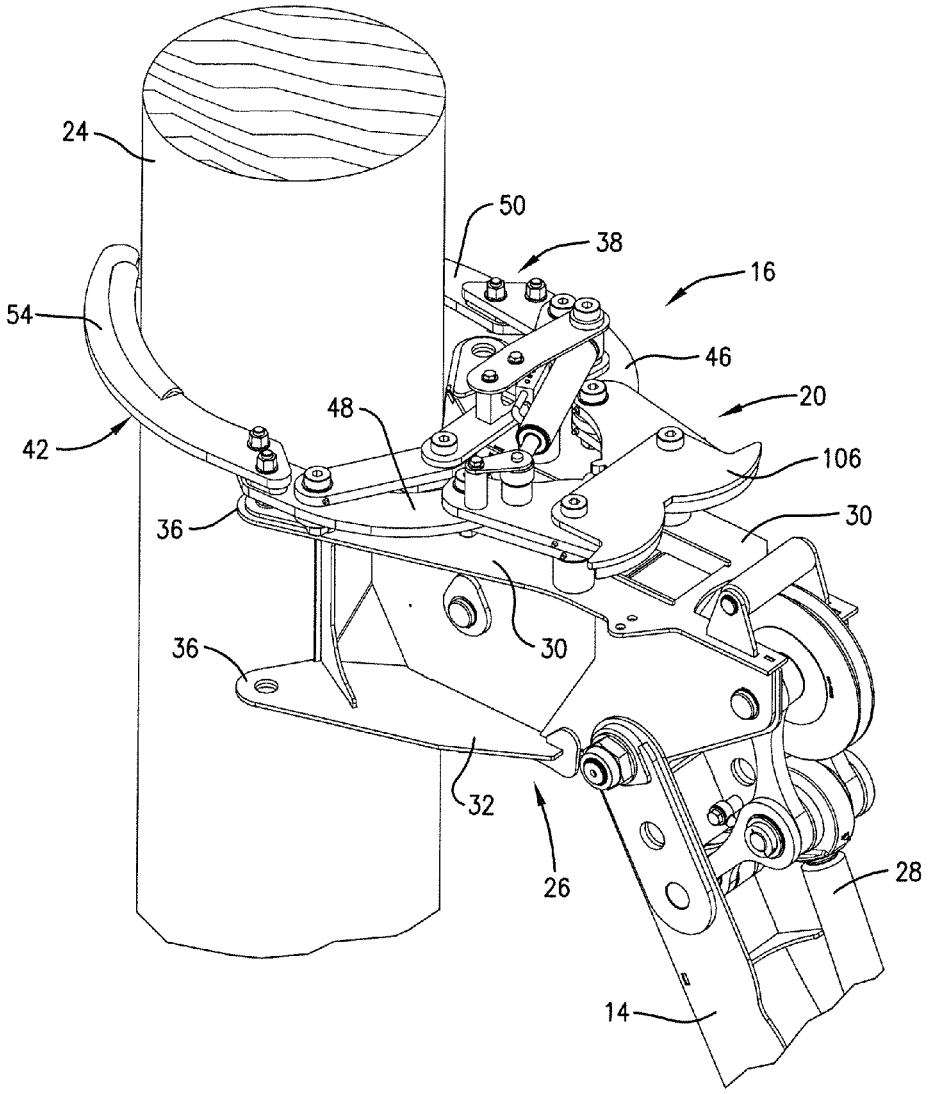
FIG. 2 is a perspective view of the load guide of the exemplary utility vehicle of FIG. 1, illustrating a distal end portion of the boom and the load guide mounted on the boom.
Figure 3:
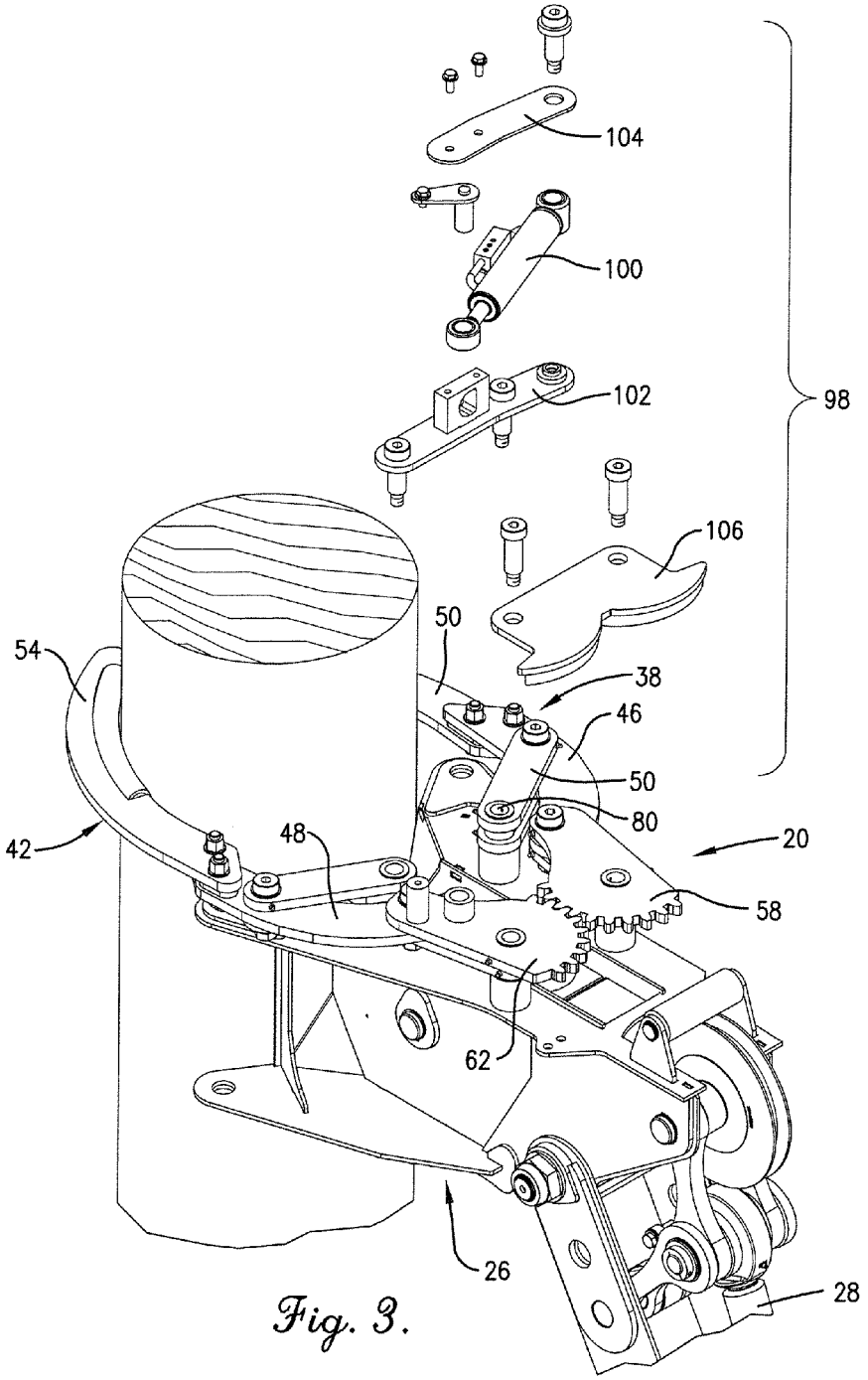
FIG. 3 is a partially exploded view of the load guide illustrated in FIG. 2, with a shield and a hydraulic actuator assembly depicted in exploded form.
Figure 4:
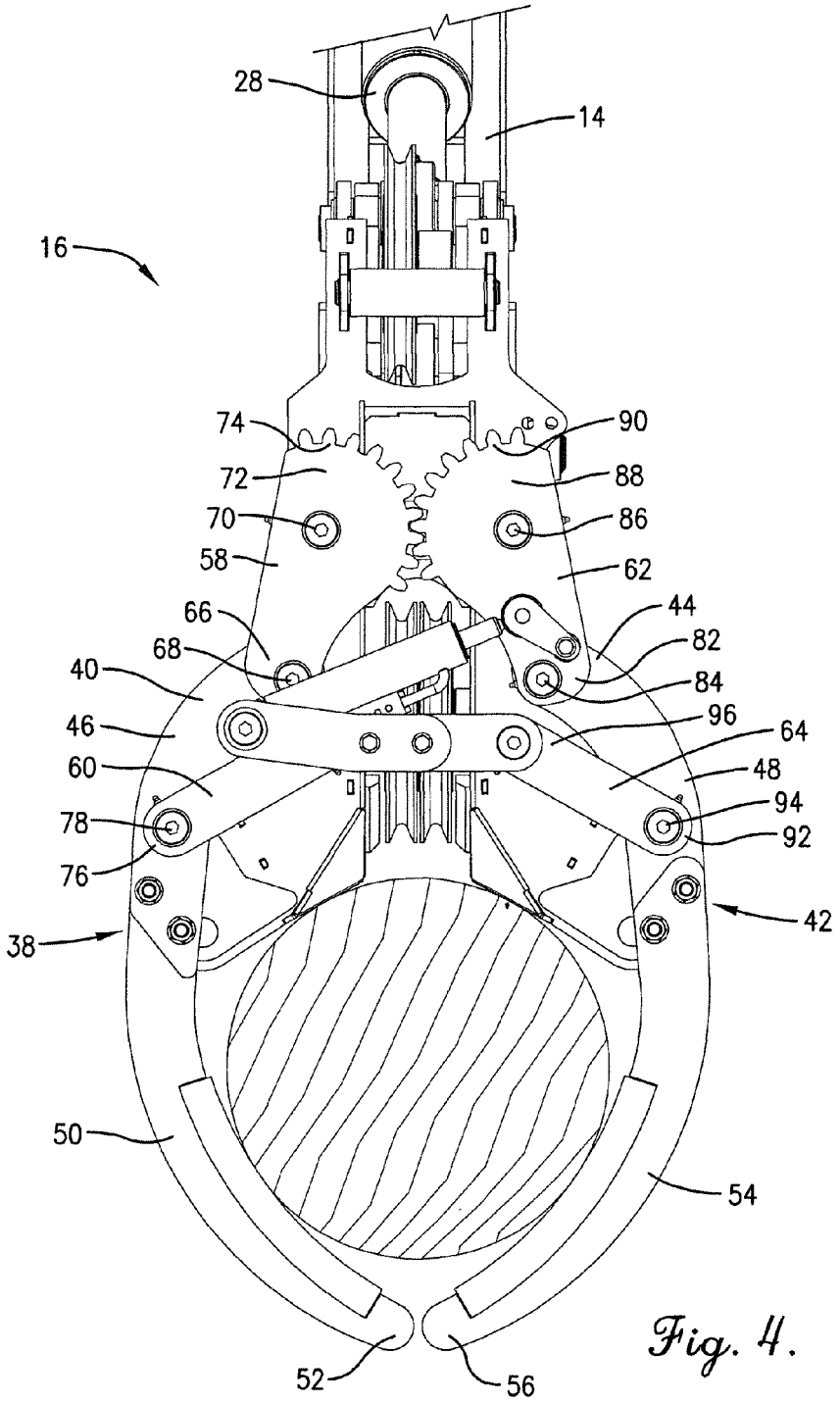
FIG. 4 is a plan view of the load guide of FIG. 1 illustrated engaging a first, larger load.
Figure 5:
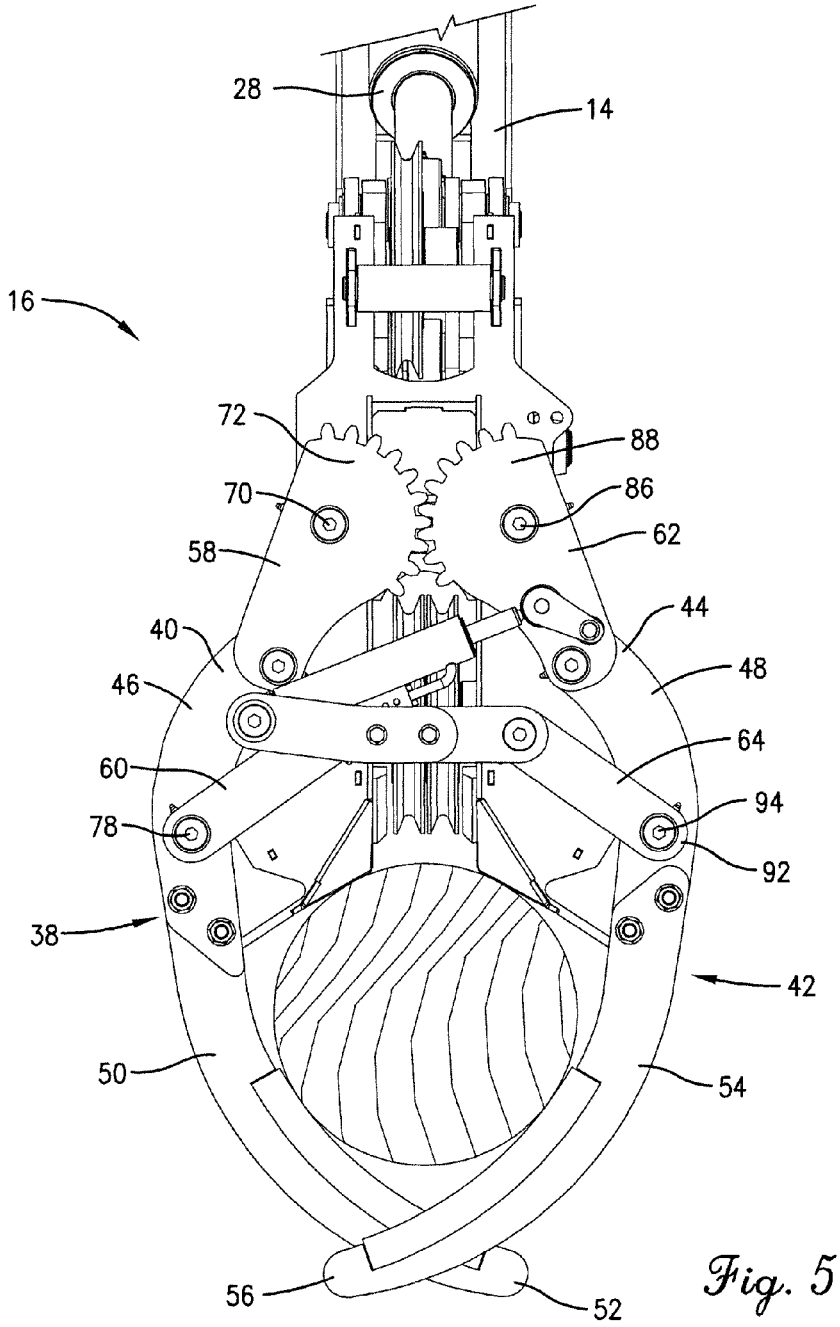
FIG. 5 is a plan view of the load guide of FIG. 1 illustrated engaging a second, smaller load.

With particular reference to FIGS. 2-5, the load guide assembly 16 includes a base 26 and an arm assembly 20 secured to the base 26. The base 26 may be pivotably attached to the distal end of the boom 14, as illustrated, and pivoted relative to the boom 14 by a hydraulic piston and cylinder assembly 28. The base 26 includes a top plate 30 and a bottom plate 32 separated by one or more vertical structural members. The base 26 further includes a front-facing front portion 34 (FIG. 7) that cooperates with the arm assembly 20 to secure the load 24 and prevent movement of the load 24 relative to the base 26, as depicted in FIGS. 4 and 5. The front portion 34 of the base 26 includes a plurality of load engaging elements 36 that each generally form a "U" or "V" shape that opens toward, and receives, the load 24. The load engaging elements 36 may include portions of the top 30 and bottom 32 plates that extend forwardly and outwardly.

As used herein, the "front" or "front portion" of the base 26 is the portion of the base 26 that is proximate to and/or engages the load 24. For example, the load engaging elements 36 are located at or near the front of the base 26. Similarly, a "back" or "back portion" of the base 26 is the portion of the base 26 that is opposite or distal the front portion 34. Thus, depending on the position of the boom 14 relative to the vehicle 10, the front of the base 26 may or may not correspond to the front of the vehicle 10.

The arm assembly 20 is secured to the top plate 30 of the base 26 and is operable to engage and secure the load 24 when in use and to be placed in a low-profile, retracted position when not in use. The arm assembly 20 comprises first and second arms 38,42 pivotably connected to a plurality of link elements that allow rotational and translational movement of the arms 38,42 relative to the base 26, such that the arms 38,42 generally act cooperatively and symmetrically when moved between operative and retracted positions. As used herein, "symmetric" movement means movement involving two elements wherein a first element on one side of the arm assembly follows the movement of a corresponding element on an opposite side of the arm assembly, such that the movement of the first element at least partially mirrors the movement of the second element.

The first and second arms 38,42 are in a generally opposed relationship with each arm 38,42 presenting an inwardly-arcuate shape for engaging the load 24. Each arm 38,42 includes a mounting portion 46,48 for attaching to the base 26 and a load engaging portion 50,54 for contacting and engaging the load 24. Each of the load engaging portions 50,54 generally extends from the respective mounting portion 46,48 to an outboard end 52,56. In the exemplary embodiment illustrated in the drawings, each of the mounting portions 46,48 is connected to the corresponding load engaging portion 50 or 54 via a plurality of bolts. It will be appreciated by those skilled in the art that each mounting portion 46,48 may be integrally formed with the corresponding load engaging portion 50 or 54, such that each of the arms 38,42 is a single, monolithic element.

The arms 38,42 are attached to the base 26 through a plurality of link elements that enable rotational and translational movement of the arms 38,42 as the arms 38,42 move between opened, engaged, and retracted positions. More particularly, a first link element 58 and a second link element 60 are each pivotably attached to both the first arm 38 and to the base 26, while a third link element 62 and a fourth link element 64 are each pivotably attached to both the second arm 42 and the base 26.

The first link element 58 generally presents an elongated shape with a first end 66 thereof pivotably connected to the first arm 38 at a pivot point 68 proximate a first end 40 of the first arm 38 that is distal the load engaging portion 50 of the arm 38. The first link element 58 is also pivotably connected to the base 26 at a pivot point 70 that is proximate a second end 72 of the link element 58. An arcuate, toothed edge portion 74 is located, in part, on the second end 72 of the link element 58 and is generally concentric about the point 70. The toothed edge portion 74 defines a lobe that extends inwardly (e.g., FIGS. 4-7) or forwardly (e.g., FIGS. 8-9), depending on the position of the arm assembly 20.

The second link element 60 generally presents an elongated shape with a first end 76 thereof pivotably connected to the first arm 38 at a point 78 between the first link element 58 and the load engaging portion 50 of the arm 38. More particularly, the second link element 60 may be pivotably connected to the mounting portion 46 of the first arm 38 proximate the load engaging portion 50 of the arm 38. A second end 80 (see FIG. 3) of the second link element 60 is pivotably connected to the base 26 at a point on the base 26 that is generally between the first link element 58 and the front portion 34 of the base 26.

The third link element 62 generally presents an elongated shape with a first end 82 thereof pivotably connected to the second arm 42 at a pivot point 84 proximate a first end 44 of the second arm 42 that is distal the load engaging portion 54 of the arm 42. The third link element 62 is also pivotably connected to the base 26 at a point 86 on the third link element 62 that is proximate a second end 88 thereof. An arcuate, toothed edge portion 90 is located, in part, on the second end 88 of the third link element 62 and is generally concentric about the point 86. The toothed edge portion 90 defines a lobe that extends inwardly (e.g., FIGS. 4-7) or forwardly (e.g., FIGS. 8-9), depending on the position of the arm assembly 20.

The fourth link element 64 presents an elongated shape with a first end 92 thereof pivotably connected to the second arm 42 at a point 94 between the third link element 62 and the load engaging portion 54 of the arm 42. More particularly, the fourth link element 64 may be pivotably connected to the mounting portion 48 of the second arm 42 proximate the load engaging portion 54 of the arm 42. A second end 96 of the fourth link element 64 is pivotably connected to the base 26 at a point on the base 26 that is generally between the third link element 62 and the front portion 34 of the base 26.

The first 58 and third 62 link elements are positioned with the toothed edge portion 74 of the first link element 58 engaging the toothed edge portion 90 of the third link element 62, such that the elements 58,62 are mechanically entrained and movement of either element causes corresponding, symmetric movement of the other element.

Figure 7:
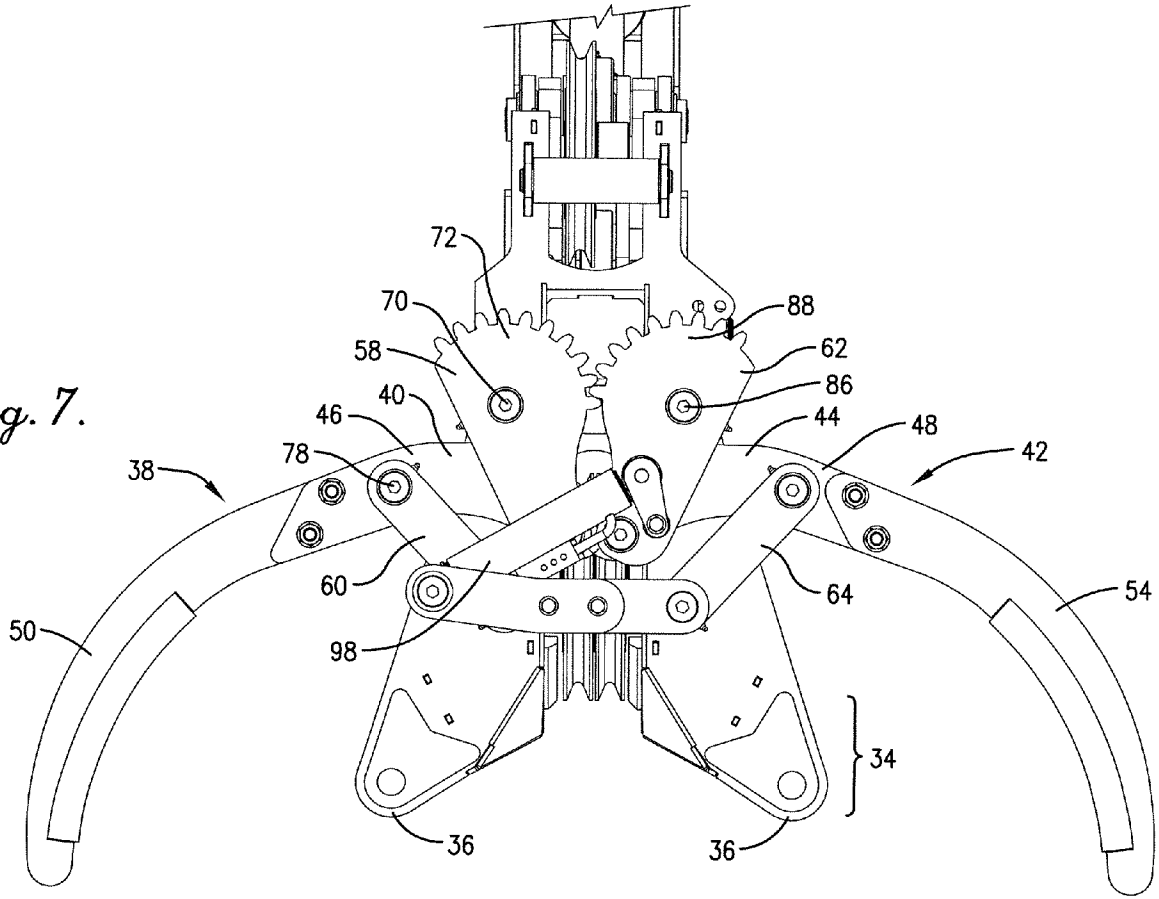
FIG. 7 is a plan view of the load guide illustrated in FIG. 6.
Figure 8:
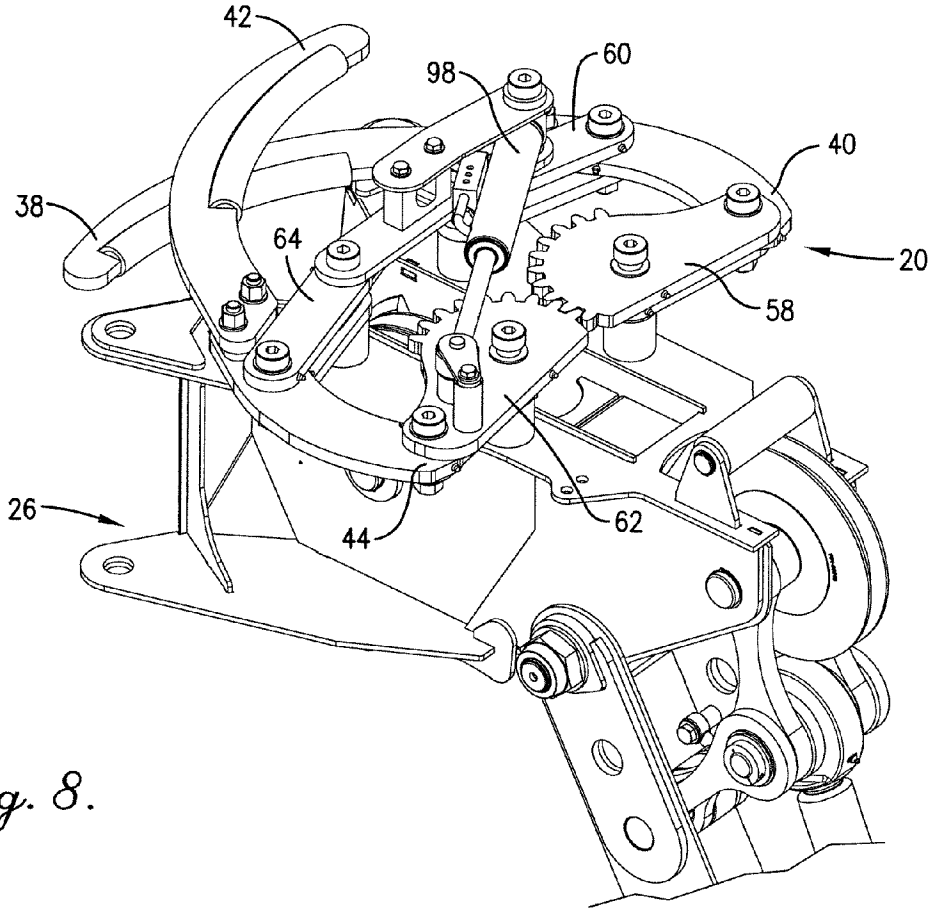
FIG. 8 is a perspective view of the load guide of FIG. 1 illustrating the arm assembly of the load guide in a retracted position.
Figure 9:
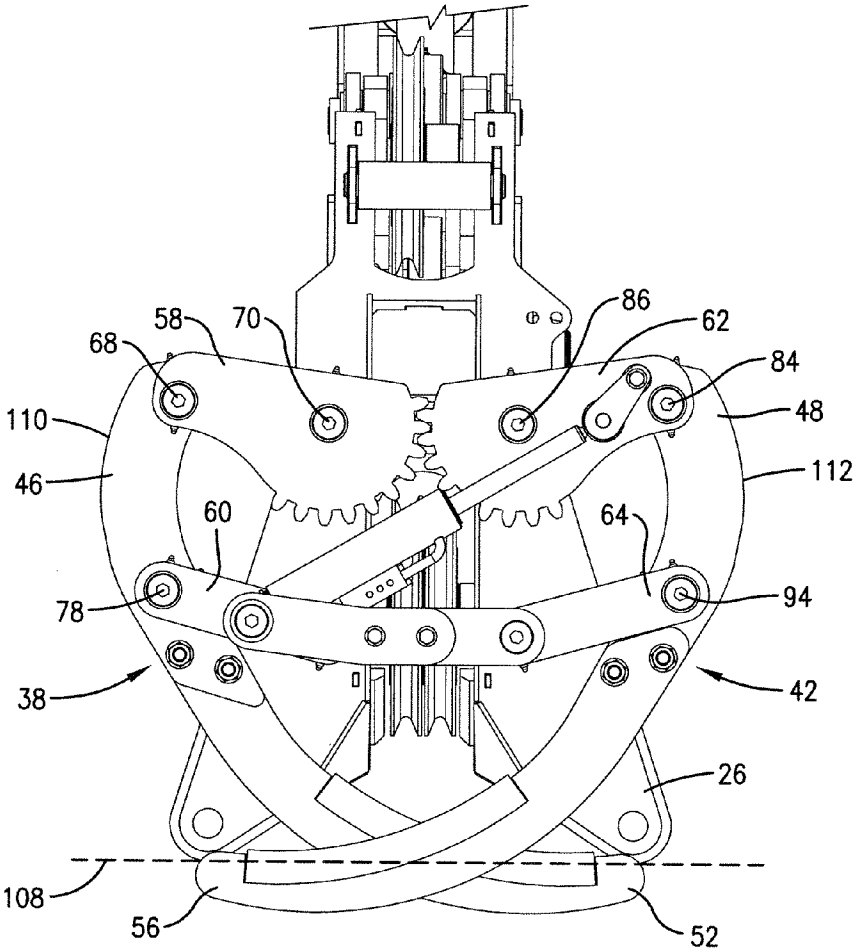
FIG. 9 is a plan view of the load guide illustrated in FIG. 8.

An actuator including a hydraulically-actuated piston and cylinder assembly 98 actuates movement of the arm assembly 20 between various positions including a fully-open position (FIGS. 6 and 7), a plurality of engaged positions (e.g., FIGS. 4 and 5), and a retracted position (FIGS. 8 and 9). The assembly 98 is also pivotably attached to the third link element 62 at a point that is approximately between the first end 82 and the second end 88 of the element 62. The assembly 98 is illustrated in exploded view in FIG. 3 and includes not only a hydraulic cylinder 100 but also one or more elongated structural bar elements 102,104 for supporting and securing the cylinder 100.

While the particular length and shape of the components of the arm assembly 20 are not critical and may vary substantially without departing from the scope of the present invention, relative sizes and positions of certain components of an exemplary embodiment of the invention will now be discussed. Furthermore, the first 58 and second 60 link elements and the first arm 38 will be discussed with the understanding that the third 62 and fourth 64 link elements and the second arm 42 may present similar or identical properties. The ratio of the length of the first link element 58 to the second link element 60 is preferably within the range of 0.75 to 1.75 and more preferably within the range of 1.0 to 1.50, and may particularly be about 1.25. The ratio of the length of the first arm 38 to the first link element 58 is preferably within the range of 1.60 to 3.60 and more preferably within the range of 2.10 to 3.10, and may particularly be about 2.60. The ratio of the length of the mounting portion 46 of the first arm 38 to the length of the load engaging portion 50 of the first arm 38 is preferably within the range of 1.25 to 3.25 and more preferably within the range of 1.5 to 3.0, and may particularly be about 1.75.

The ratio of the distance between pivot points 70 and 86 to the distance between pivot points 70 and 68 is preferably within the range of 0.6 to 1.8, more preferably within the range of 0.9 to 1.5, and may particularly be about 1.2. The ratio of the distance between pivot points 68 and 78 to the distance between pivot points 68 and 70 is preferably within the range of 0.6 to 1.8, more preferably within the range of 0.9 to 1.5, and may particularly be about 1.2. The ratio of the distance between pivot point 78 and distal end 52 to the distance between pivot point 68 and pivot point 78 is preferably within the range of 2.0 to 4.0, more preferably within the range of 2.5 to 3.5, and may particularly be about 3.0.

When the arm assembly 20 is in an open position (e.g., FIG. 7) the ratio of the distance between pivot points 70 and 86 to the distance between pivot points 68 and 84 is preferably within the range of 2.0 to 4.0, more preferably within the range of 2.5 to 3.5, and may particularly be about 3.0. When the arm assembly 20 is in an engaged position (e.g., FIGS. 4 and 5), the ratio of the distance between pivot points 70 and 86 to the distance between pivot points 68 and 84 is preferably within the range of 0.25 to 1.25, more preferably within the range of 0.5 to 1.0, and may particularly be about 0.75. When the arm assembly 20 is in the retracted position (e.g., FIG. 9), the ratio of the distance between pivot points 68 and 84 to the distance between pivot points 70 and 86 is preferably within the range of 1.5 to 3.5, more preferably within the range of 2.0 to 3.0, and may particularly be about 2.6.

As illustrated in FIGS. 2 and 3, a shield 106 may be positioned over the toothed edge portion 74 of the first link element 58 and the toothed edge portion 90 of the third link element 62 and protect the link elements 58,62 from debris and the like. The shield 106 is omitted from FIGS. 1 and 4-9 for illustrative purposes only.

Figure 6:
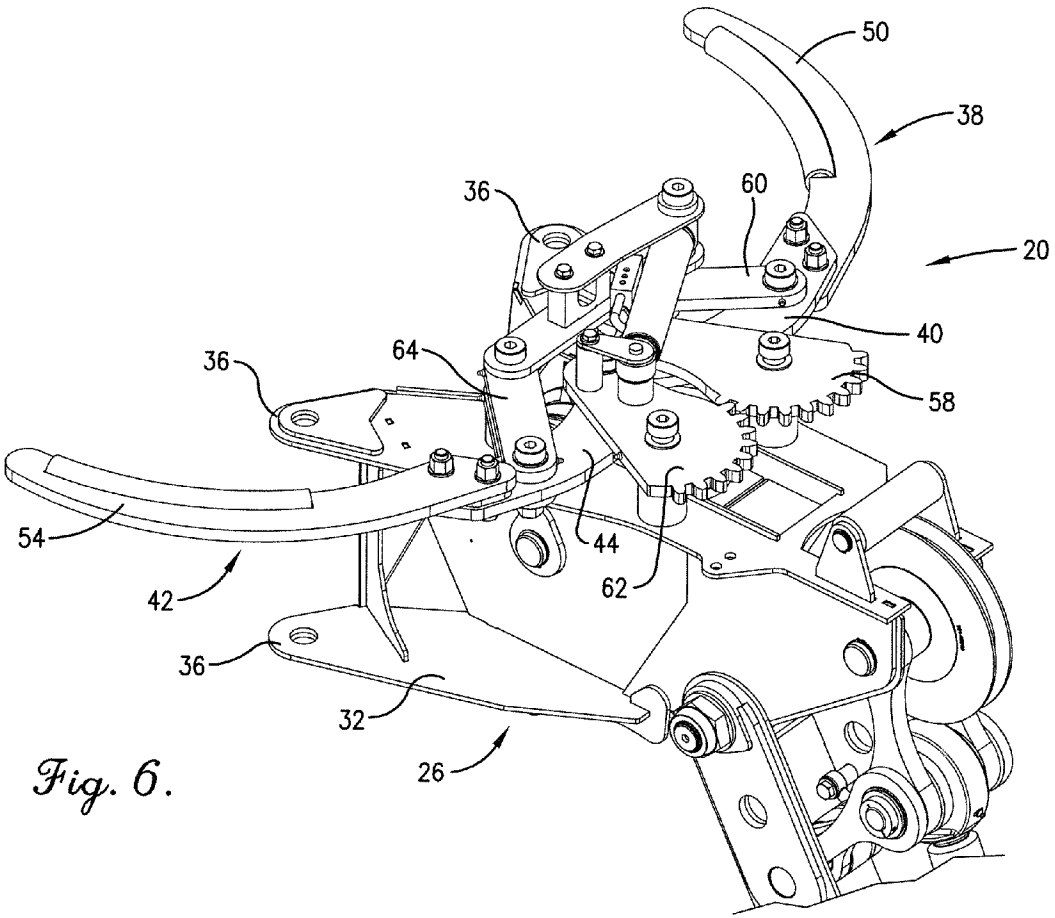
FIG. 6 is a perspective view of the load guide of FIG. 1 illustrating the arm assembly of the load guide in an open position.

Operation and use of the load guide assembly 16 will now be described in greater detail. The arm assembly 20 is placed in an open position as illustrated in FIGS. 6 and 7 when the hydraulic cylinder assembly 98 is moved to a retracted position, causing the first end 82 of the third link element 62 to pivot forward and inward toward the center of the base 26. This movement causes the first end 66 of the first link element 58 to similarly pivot forward and inward. This inward pivoting movement of the first 58 and third 62 link elements causes the first end 40 of the first arm 38 and the first end 44 of the second arm 42 to move forward and inward relative to the base 26, which causes the load engaging portions 50,54 of the arms 38,42 to rotate outward and backward relative to the base 26 about the second 60 and fourth 64 link elements.

When the load guide assembly 16 is placed in a position to engage a load, the arm assembly 20 is moved from the open position to an engaged position causing the arms 38,42 to engage the load. With particular reference to FIGS. 4 and 5, the arms 38,42 are moved to the engaged position from the open position when the hydraulic piston assembly 98 is partially extended so that the first end 82 of the third link element 62 is pivoted outward. This causes the first ends 40,44 of the arms 38,42 to move outward and backwards relative to the base 26, and the load engaging portions 50,54 of the arms 38,42 to rotate inward toward the load about the second 60 and fourth 64 link elements. The hydraulic piston assembly 98 continues to move the arms 38,42 inward until the arms 38,42 engage the load 24. As the arms 38,42 engage the load 24, the load 24 is pulled toward the load engaging elements 36 of the base 26 until the load 24 engages the arms 38,42 and the base 26. Once the arm assembly 20 is in this position, the portion of the load 24 in contact with the load guide assembly 16 is held steady relative to the boom 14, facilitating guidance and placement of the load 24.

The open position and the various engaged positions are referred to herein as "operative positions," as these are the positions used by the load guide assembly 16 during normal use and operation of the load guide assembly 16. In contrast, the load guide assembly 16 may be placed in a retracted position (described below) when not in use.

As best illustrated in FIGS. 5, 8 and 9, the arms 38,42 are configured such that a portion of a length of the arms overlap. This may be accomplished, for example, by securing the load engaging portion 50 of the first arm 38 to a lower or under side of the mounting portion 46 of the first arm 38 and securing the load engaging portion 54 of the second arm 42 to an upper or top side of the mounting portion 48 of the second arm 42, such that the load engaging portion 50 of the first arm 38 is vertically offset from the load engaging portion 54 of the second arm 42. This vertical offset allows the arms 38,42 to overlap or pass by one another, which is necessary, for example, when the load guide assembly 16 engages smaller loads (e.g., FIG. 5) or is placed in the retracted position (e.g., FIG. 8).

When the load guide assembly 16 is not in use, it may be desirable to retract the arm assembly 20, thereby reducing the profile or envelope of the load guide assembly 16. This may be desirable, for example, where the boom 14 (but not the load guide assembly 16) is operated in a confined area or in an area with overhead hazards, such as power lines, tree limbs, or the like. If the arm assembly 20 were left in an operative position during such use, the arms 38,42 would be more likely to interfere with the truck's surroundings. Placing the arm assembly 20 in the retracted position greatly reduces the risk of such interference.

With particular reference now to FIGS. 4, 5, 8 and 9, the arm assembly 20 is moved from an operative position (e.g., either of the engaged positions illustrated in FIGS. 4 and 5) to the retracted position when the hydraulic piston assembly 98 is extended, such that the first end 82 of the third link element 62 is pivoted outward and backward relative to the base 26. This movement causes the first ends 40,44 of the arms 38,42 to move outward and backward relative to the base 26 and causes the load engaging portions 50,54 of the arms 38,42 to rotate inwardly about the second 60 and fourth 64 link elements. Thus, as the arms 38,42 move from an operative position to the retracted position, they undergo not only rotational movement, wherein the load engaging portion 50,54 of each arm 38,42 rotates inward or toward the other arm, but also translational movement toward the back of the base 26.

The rotational movement of the arms 38,42 occurs, at least in part, about points 78 and 94. This rotation about intermediate points (such as points 78 and 94) of the arms facilitates positioning the arms in a reduced envelope. The points 78 and 94 are separated from the first ends 40 and 44, respectively, by a distance that is about one-fourth of a total length of each arm 38,42. Alternatively, pivot points 78 and 94 may be positioned close to a mid-point of each arm 38,42, or even closer to the second ends 52,56 of the arms 38,42.

Placing the arms 38,42 in the retracted position reduces the profile of the arm assembly 20. As illustrated in FIGS. 4 and 5, for example, when the arms 38,42 are in an engaged position, most of the load engaging portions 50,54 of the arms 38,42 extend beyond the front portion 34 of the load guide base 26. In contrast, and as illustrated in FIG. 9, when the arm assembly 20 is in the retracted position, the load engaging portions 50,54 of the arms 38,42 are mostly positioned behind the front portion 34 of the load guide base 26. Described another way, when the arms 38,42 are in an operative position, most of the load engaging portions 50,54 of the arms 38,42 extend beyond an imaginary line 108 corresponding to the most forward portions of the base 26, and when the arm assembly 20 is in the retracted position, the load engaging portions 50,54 of the arms 38,42 are positioned mostly behind the imaginary line 108. Described yet another way, when the arm assembly 20 is in the retracted position, distal ends 52,56 of the arms 38,42 are within the greatest horizontal width of a profile of the arms 38,42. In the plan view depicted in FIG. 9, for example, outer edges 52,56 of the mounting portions 46,48 of the arms 38,42 define the greatest horizontal width of the profile of the arms 38,42, while the distal ends 52,56 are positioned horizontally inward of the outer edges 52,56 mounting portions 46,48.

It should also be noted that when the arm assembly 20 is in the retracted position, the forward and outward facing portions of the arms 38,42 present relatively smooth, inwardly-curved outer edges, as best illustrated in FIG. 9. This further reduces the risk of interference with surroundings by minimizing the number of protrusions that may snag elements of the surroundings, such as wires or tree limbs.

Figure 10:
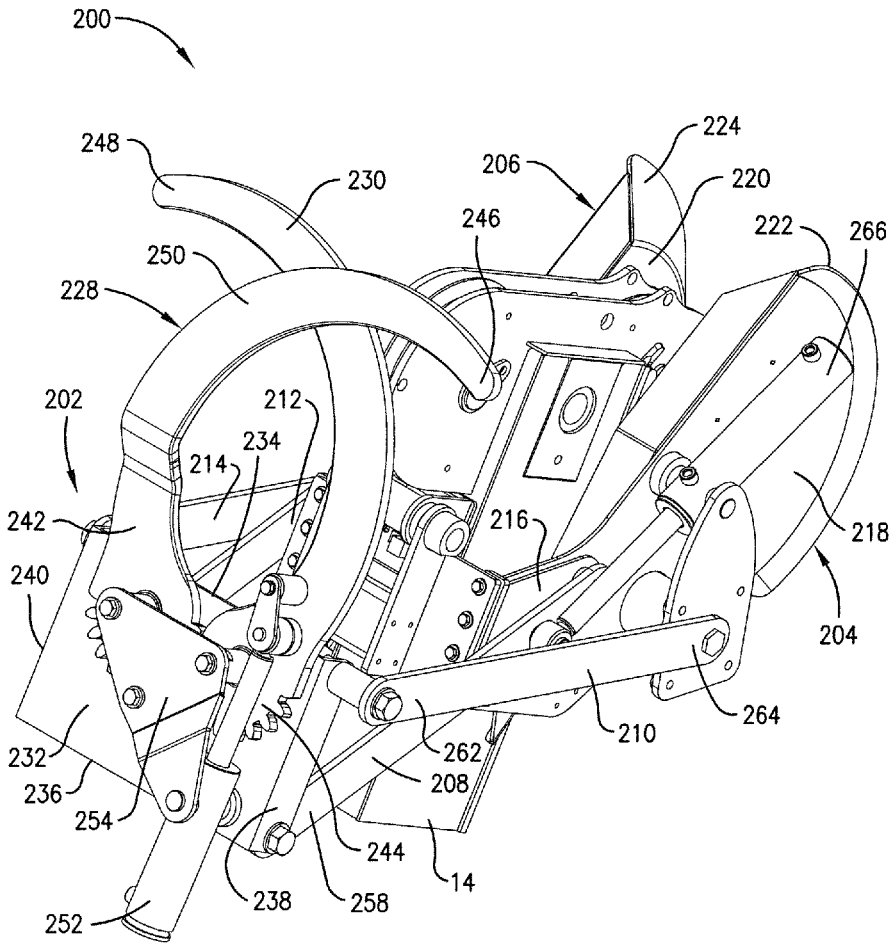
FIG. 10 is a perspective view of another embodiment of the load guide with a retractable arm assembly.
Figure 11:
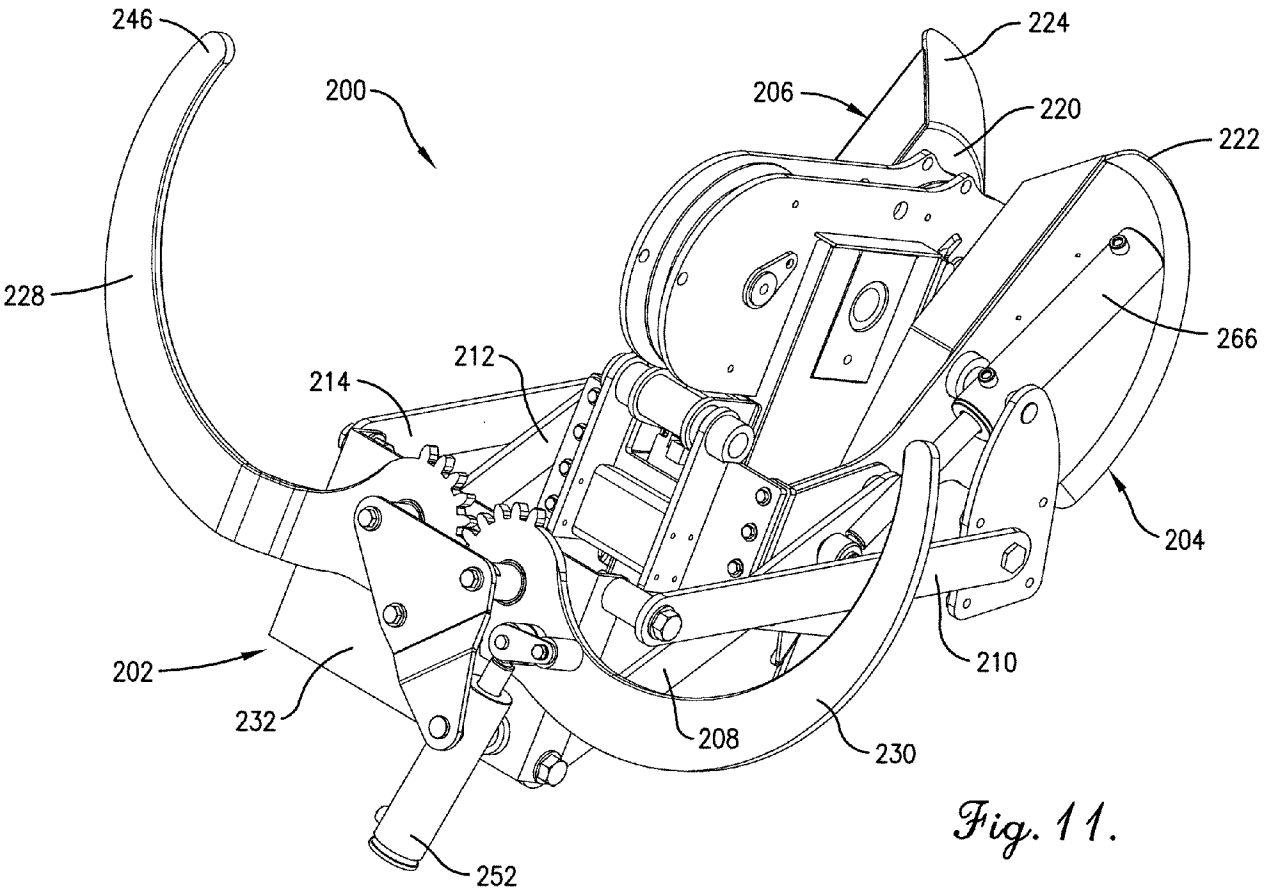
FIG. 11 is a perspective view of the load guide illustrated in FIG. 10, illustrating the arm assembly of the load guide in an open and retracted position.
Figure 12:
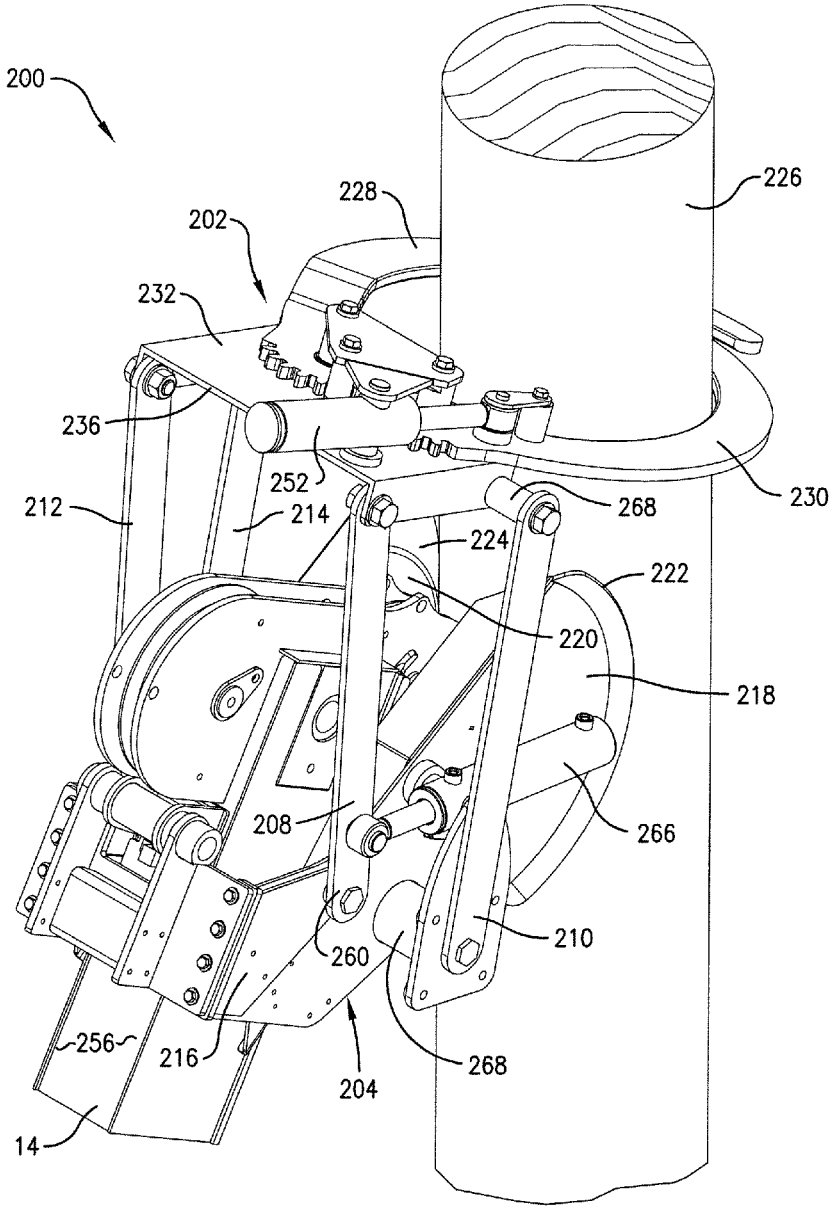
FIG. 12 is a perspective view of the load guide of FIG. 10, illustrated engaging a load.

A load guide 200 with a retractable arm assembly 202 constructed according to another embodiment of the invention is illustrated in FIGS. 10 through 12. The load guide 200 broadly includes a pair of side plates 204,206 positioned on opposite sides of the boom 14 and a plurality of linking bars 208,210,212,214 movably securing the arm assembly 202 to the side plates 204,206.

A first side plate 204 is positioned on a first side of the boom 14 proximate the boom tip and a second side plate 206 is positioned on a second side of the boom 14 opposite the first side plate 204. Each side plate 204,206 includes a neck portion 216 (not shown on the second side plate 206) generally adjacent the boom 14 and a load engaging portion 218,220 extending outwardly and upwardly (that is, in the direction of the boom tip) from the boom 14. The load engaging portions 218,220 include longitudinally arcuate outwardly directed outer edge portions 222,224 that are transversely flared outwardly in opposite directions to present inwardly facing convex surfaces for engaging the surface of a load 226, as illustrated in FIG. 12. The outer edge portions 222,224 are curved to facilitate engaging the load 226 held against the side plates 204,206 and maintaining the load 226 in engagement with outer edge portions 222,224, regardless of the angle of boom 14 relative to the longitudinal axis of load 226, and without changing the length of loadline 18 as boom 14 is rotated to vary the angle between the longitudinal axis thereof and the axis of the load 226. Thus, once the load 226 is snugged against outer edge portions 222,226 of side plates 204,206, and the loadline 18 is coupled to the load 226, the load 226 will stay in firm engagement with the load guide 200 as the boom 14 is pivoted up and down without the necessity of altering the length of the loadline 18.

The arm assembly 202 includes first 228 and second 230 inwardly arcuate arms each pivotably mounted on a generally planar arm assembly platform 232, such that the arms 228, 230 are in an opposing relationship one with the other. The platform 232 is defined by a front edge 234, a back edge 236, a first side 238 and a second side 240. A first end 242 of the first arm 228 is pivotably mounted at a single point proximate the front edge 234 of the arm assembly platform 232. Similarly, a first end 244 of the second arm 230 is pivotably mounted at a separate, single point proximate the front edge 234 of the arm assembly platform 232. A second end 246,248 of each arm 228,230 distal the first end 242,244 swings about the first end 242,244 along a curved path when the arms 228,230 move between closed (e.g., FIG. 10) and open (e.g., FIG. 11) positions. The first arm 228 includes a raised portion 250 that is vertically offset relative to the second arm 230 to allow the arms 228,230 to at least partially overlap, as best illustrated in FIG. 10. The first end 242,244 of each arm 228,230 includes a rounded, toothed end portion that engages an opposing, similar toothed portion of the other arm such that rotation of one of the arms 228,230 induces corresponding symmetrical rotation in the other arm.

A first actuator 252, such as a hydraulic cylinder assembly, is connected to the platform 232 and to the second arm 230 and operates to move the arms 228,230 between the closed position illustrated in FIG. 10 and the open position illustrated in FIG. 11. The first actuator 252 may be connected to either of the first arm 228 or the second arm 230. A shield element 254 may be mounted proximate the actuator 252 and the first end 242,244 of each arm 228,230 to provide stability and protection for the arms 228,230 and the first actuator 252.

The linking bars 208,210,212,214 are pivotably connected to the arm assembly platform 232 and to the side plates 204,206 and guide movement of the arm assembly 202 between a stowed position, illustrated in FIG. 10, and an operative position, illustrated in FIG. 12. In the stowed position the arm assembly 202 is positioned adjacent or proximate the top side of the boom (opposite the outer edge portions of the side plates) and behind the boom tip (i.e., positioned between the boom tip and the boom base mounted on the utility vehicle 10). In the stowed position the arms 228,230 may lie in a plane that is parallel or nearly parallel with a longitudinal axis of the boom 14, with a top surface 256 of the boom 14, or both. In the operative position the arm assembly 202 is positioned beyond the boom tip with the arms 228,230 generally lying in a plane that is perpendicular to the longitudinal axis of the boom 14 or within about sixty degrees of perpendicular, depending on the position of the boom 14 relative to the load 226. In the operative position the arms 228,230 extend forward (toward the load 226) beyond the outer edge portions 222,224 of the side plates 204,206.

The illustrated embodiment includes two linking bars on each side of the load guide 200. Linking bars 208 and 210 will be described in detail with the understanding that linking bars 212 and 214 may be configured similarly to linking bars 208 and 210.

A first end 258 of the first linking bar 208 is rotatably connected to the platform 232 proximate the back edge 236 and the first side 238, and a second end 260 of the first linking bar 208 is rotatably connected to a first point on the first side plate 204. A first end 262 of the second linking bar 210 is rotatably connected to the platform 232 near the front edge 234 and the first side 238, and a second end 264 of the second linking bar 210 is rotatably connected to a second point on the first side plate 204. The second end 260 of the first linking bar 208 and the second end 264 of the second linking bar 210 may be positioned on a line that is perpendicular or nearly perpendicular to a longitudinal axis of the boom 14. A second actuator 266, such as a hydraulic cylinder assembly, is connected to the first side plate 204 and to the first linking bar 208 and operates to move the arm assembly 202 between the stowed and operative positions by rotating the first linking bar 208 relative to the first side plate 204. A pair of spacer elements 268 separate the second linking bar 210 from the first side plate 204 by a space to accommodate the second actuator 266.

While the particular length and shape of the various components of the load guide 200 are not critical and may vary substantially without departing from the scope of the present invention, the sizes and positions of certain components of an exemplary embodiment of the load guide 200 will now be discussed. The length of the first arm 228 is preferably within the range of from about six inches to about four feet and more preferably within the range of from about one foot to about three feet. In particular, the length of the first arm 228 may be approximately one foot, one and one-half feet, two feet, two and one-half feet, or three feet. The second arm 230 may be similarly configured.

The first linking bar 208 and the second linking bar 210 may be the same length or nearly the same length, and the distance between the first end 258 of the first bar 208 and the first end 262 of the second bar 210 may be approximately one-third of the length of either linking bar 208,210. The distance between the second end 260 of the first bar 208 and the second end 264 of the second bar 210 may be approximately one-fourth of the length of either bar 208,210. The length of the first linking bar 208 and of the second linking bar 210 may be within the range of from about six inches to about four feet and more preferably within the range of from about one foot to about three feet. In particular, the length of each of the first linking bar 208 and the second linking bar 210 may be approximately one foot, one and one-half feet, two feet, two and one-half feet, or three feet. The third 212 and fourth 214 linking bars may be similarly configured.

Figure 13:
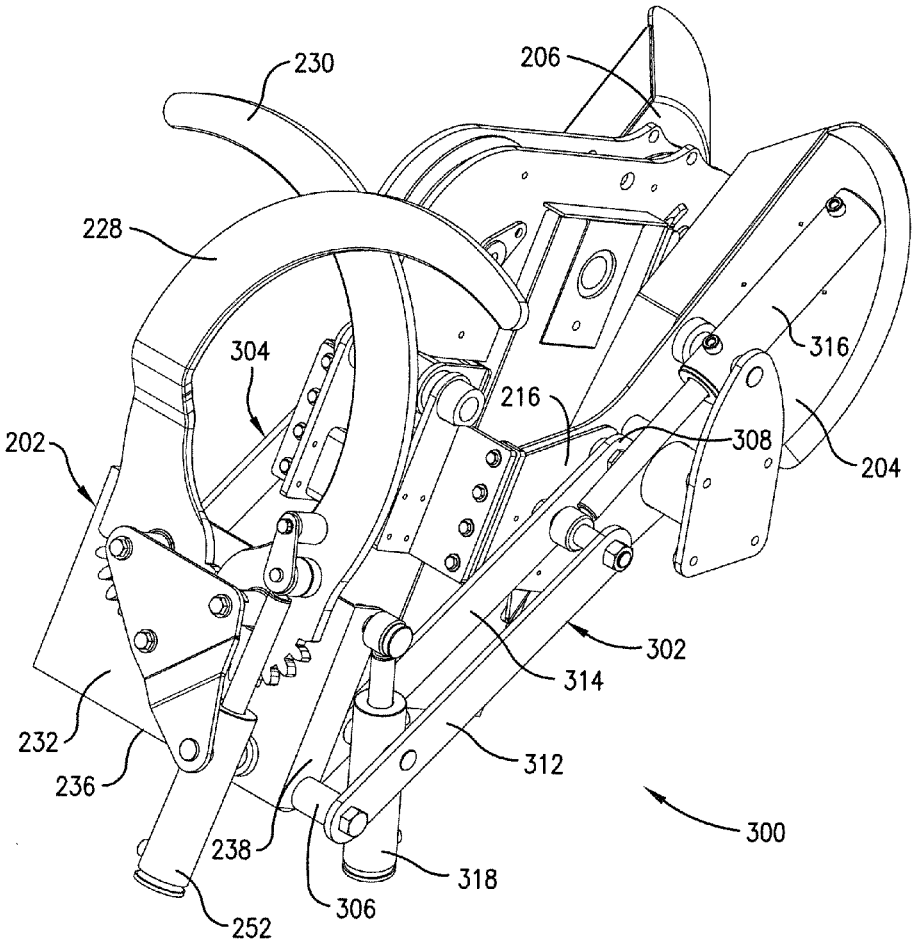
FIG. 13 is a perspective view of yet another embodiment of the load guide with pivot arms to guide the arm assembly between a retracted position and an operative position.
Figure 14:
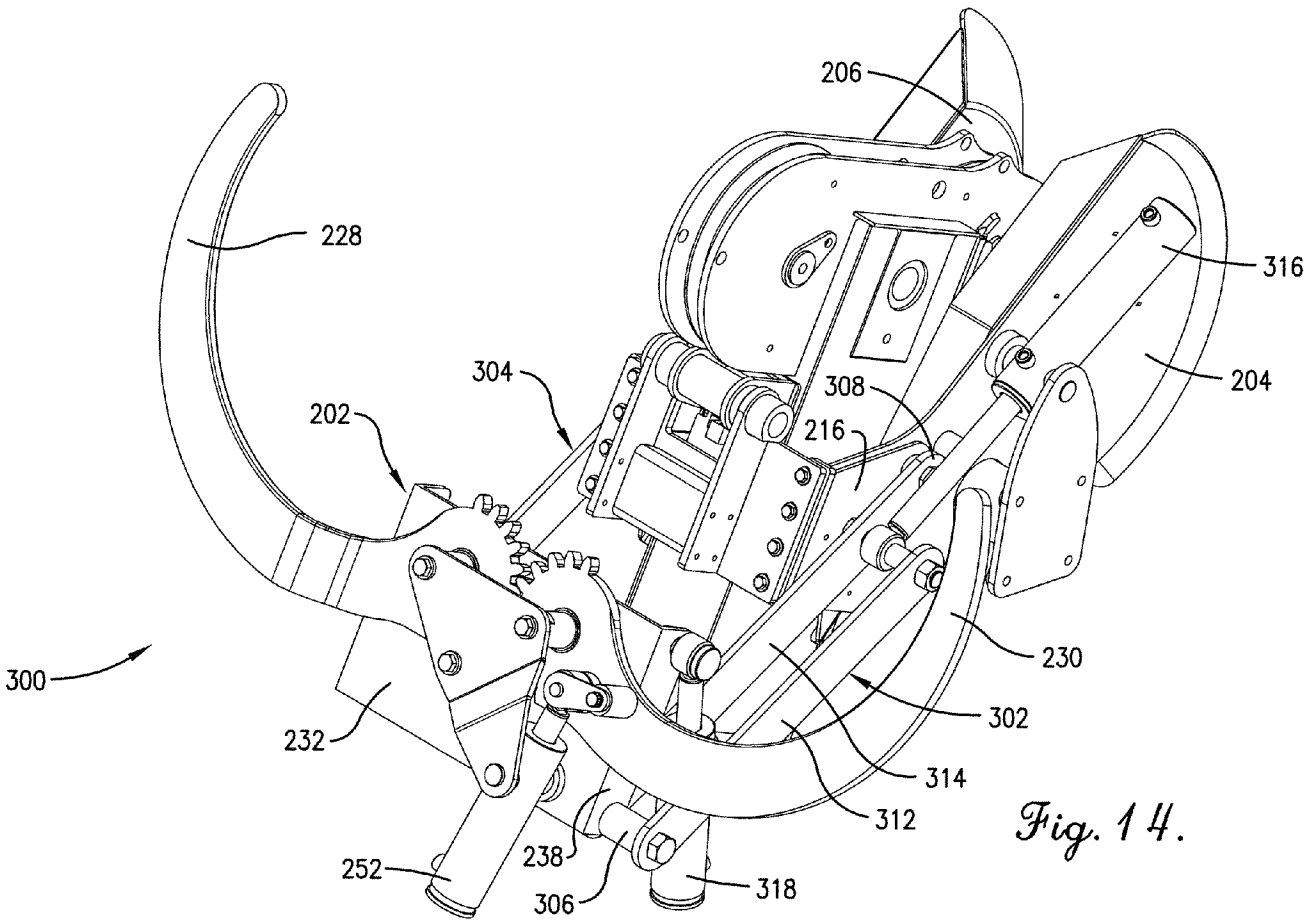
FIG. 14 is a perspective view of the load guide of FIG. 13 illustrating the arm assembly of the load guide in an open and retracted position.
Figure 15:
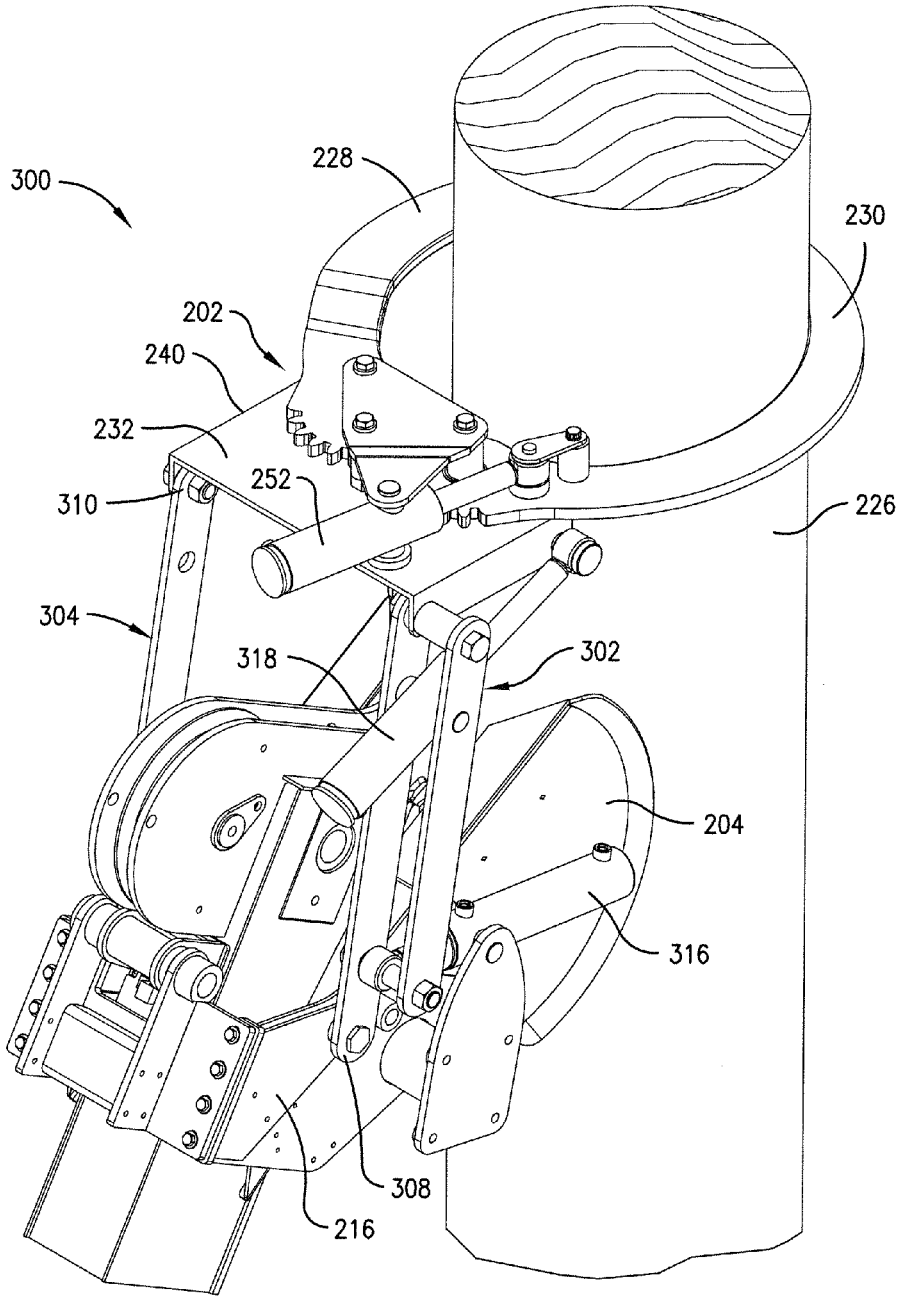
FIG. 15 is a perspective view of the load guide illustrated in FIG. 13 illustrating engaging a load.

A load guide 300 constructed according to another embodiment of the invention is illustrated in FIGS. 13 through 15. The load guide 300 broadly includes the side plates 204,206 positioned on opposite sides of the end of the boom 14 as described above, the arm assembly 202 as described above, and a pair of pivot arms 302,304 movably securing the arm assembly 202 to the side plates 204,206.

The first and second pivot arms 302,304 guide the arm assembly 202 between a retracted position, illustrated in FIG. 13, and an operative position, illustrated in FIG. 15. The stowed position and the operative position correspond to the stowed and operative positions discussed above relative to the load guide 200.

A first end 306 of the first pivot arm 302 is rotatably connected to the platform 232 at or proximate the back edge 236 and the first side 238 of the platform 232. A second end 308 of the first pivot arm 302 is rotatably connected to the neck portion 216 of the first side plate 204. A first end 310 of the second pivot arm 304 is rotatably connected to the platform 232 at a single point at or proximate the second side 240 and the back edge 236 of the platform 232. A second end (not illustrated) of the second pivot bar 304 is rotatably connected to the neck portion of the second side plate 206.

The first pivot arm 302 includes two bar elements 312,314 separated by a space to accommodate second 316 and third 318 actuators. The second actuator 316 may be a hydraulic cylinder assembly and is pivotably connected to the first side plate 204 and to the first pivot arm 302. The second actuator 316 operates to move the arm assembly 202 between the stowed and operative positions. The third actuator 318 may be a hydraulic cylinder assembly and is pivotably connected to the first pivot arm 302 and to the arm assembly platform 232 and operates to pivot the platform 232 relative to the pivot arms 302,304. Thus, the second 316 and third 318 actuators cooperate to move the arm assembly 202 between the stowed and operative positions and to pivot the arm assembly 202 into position to engage the load 226.

While the particular length and shape of the various components of the load guide 300 are not important and may vary substantially without departing from the scope of the present invention, the length of each of the first 302 and second 304 pivot arms may be within the range of from about six inches to about four feet and more preferably within the range of from about one foot to about three feet. In particular, the length of each of the first 302 and second 304 pivot arms may be approximately one foot, one and one-half feet, two feet, two and one-half feet, or three feet.

In operation, the arm assembly 202 is placed in the stowed position when not in use, wherein the first actuator 252 is extended to rotate the arms 228,230 to the closed position, the second actuator 316 is extended to rotate the first pivot arm 302 and the arm assembly 202 away from the boom tip, the third actuator 318 is retracted to pivot the arm assembly 202 downward relative to the pivot arms 302,304 and to the boom 14, as illustrated in FIG. 13. In this position the arm assembly 202 is on an opposite side of the boom 14 from the load 226 and does not extend beyond the boom tip, thereby minimizing interference with operation of the boom 14. When the load guide 300 is used to engage the load 226, the first actuator 252 is retracted to rotate the arms 228,230 to the open position, the second actuator 316 is activated to rotate the first pivot arm 302 and the arm assembly 202 toward the boom tip, and the third actuator 318 is extended to pivot the arm assembly 202 away from the pivot arms 302,304 and toward the load 226, as illustrated in FIGS. 14 and 15. The first actuator 252 may then be extended to at least partially close the arms 228,230 around the load 226.

A load guide 400 constructed according to another embodiment of the invention is illustrated in FIGS. 16 through 19. The load guide 400 broadly includes the side plates 204,206 positioned on opposite sides of the end of the boom 14 as described above, the arm assembly 202 as described above, and a track assembly 402 rotatably attached to the side plates 204,206.

The track assembly 402 includes a pair of V-shaped pivot arms 404,406 rotatably attached to the side plates 204,206. More particularly, a first end 408 of a first pivot arm 404 is rotatably attached to the first side plate 204, and a second end 410 of the first pivot arm 404 is fixedly attached to a track assembly base 412. The second pivot arm 406 is rotatably attached to the second side plate 206 and fixedly attached to the track assembly base such that the pivot arms 404,406 guide movement of the track assembly base 412 relative to the side plates 204,206. A pair of rails 414,416 are mounted on the track assembly base 412 and generally extend rearward from the base 412, or away from the tip of the boom. A plurality of sliders 418 are mounted to an undercarriage of the arm assembly 202 and slidably engage the rails 414,416. It will be appreciated that a different number of rails or other slide mechanisms may be employed without departing from the spirit or scope of the invention. By way of example, configurations may be adapted that include three, four, five or more rails. Furthermore, in some circumstances a single rail may be used.

A second actuator 420, such as a hydraulic cylinder assembly, is pivotably connected to the first side plate 204 and to the first rotator arm 404 and pivots the track assembly 402 and the arm assembly 202 about the ends of the rotator arms 404,406 that are rotatably connected to the side plates 204,206. A third actuator 422, such as a hydraulic cylinder assembly, is attached to both the track assembly 402 and the arm assembly 202 and moves the arm assembly 202 forward and backward along the rails 414,416.

Figure 16:
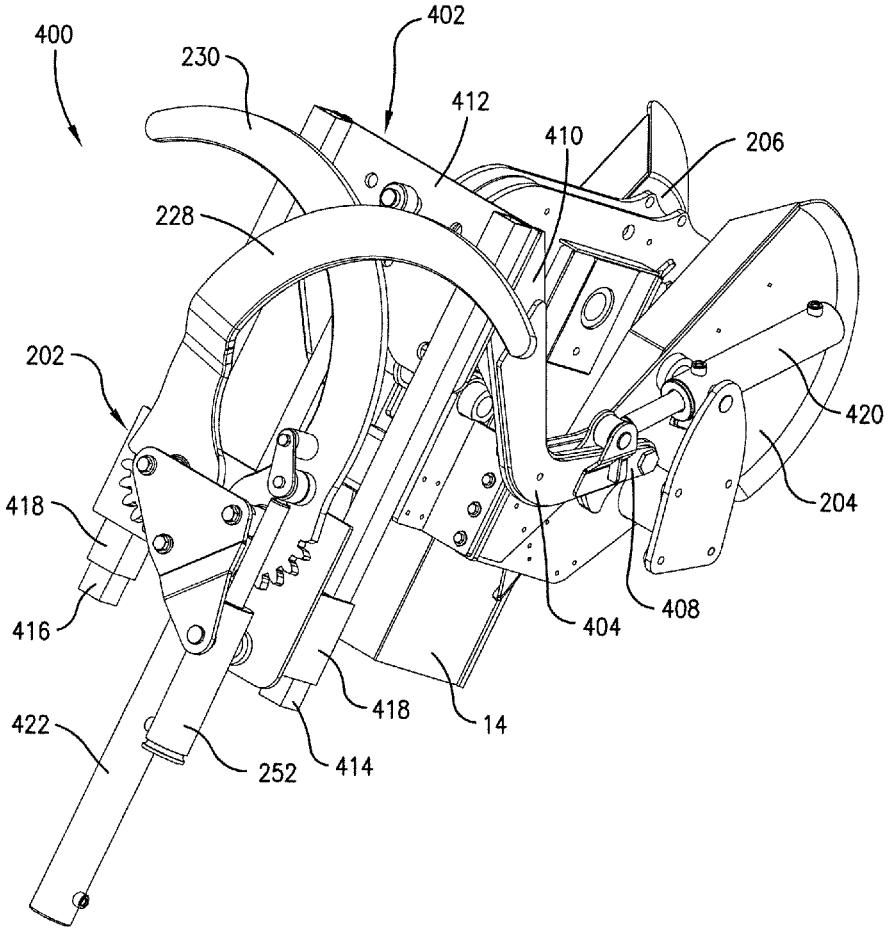
FIG. 16 is a perspective view of yet a further embodiment of the load guide with a pair of V-shaped pivot arms.
Figure 17:
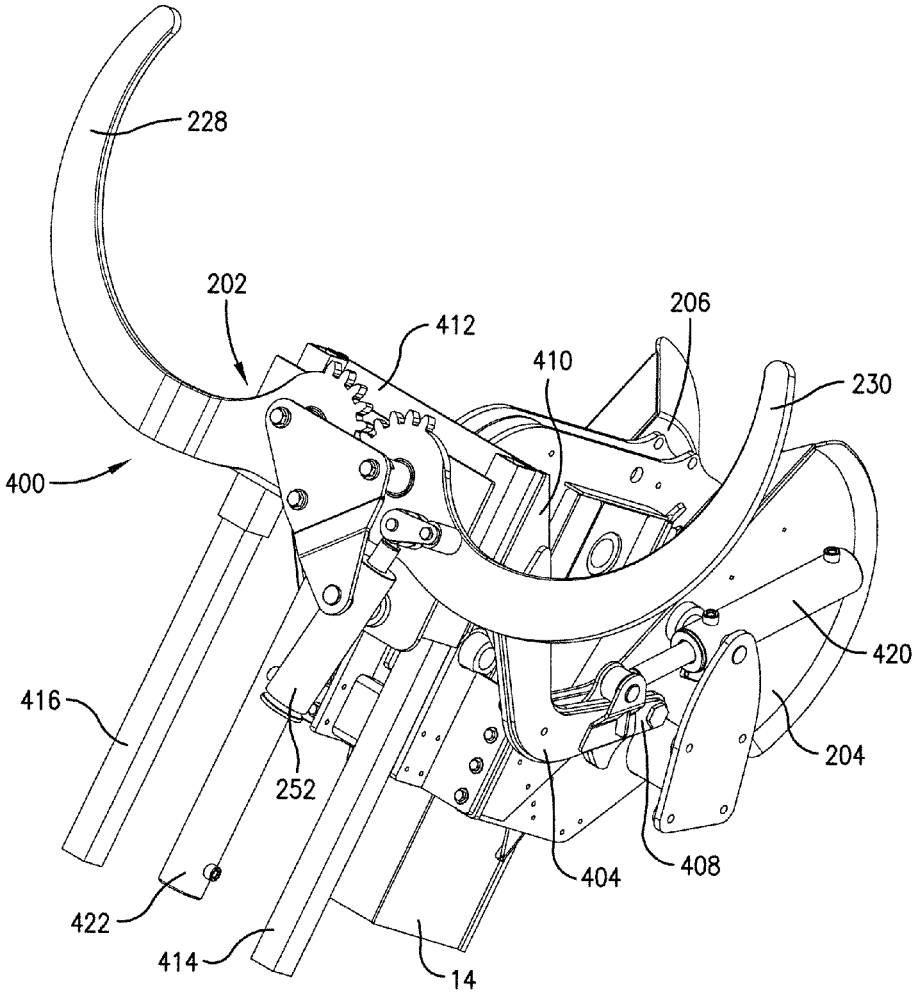
FIG. 17 is a perspective view of the load guide of FIG. 16, illustrating the arm assembly of the load guide in an open and operative position.
Figure 18:
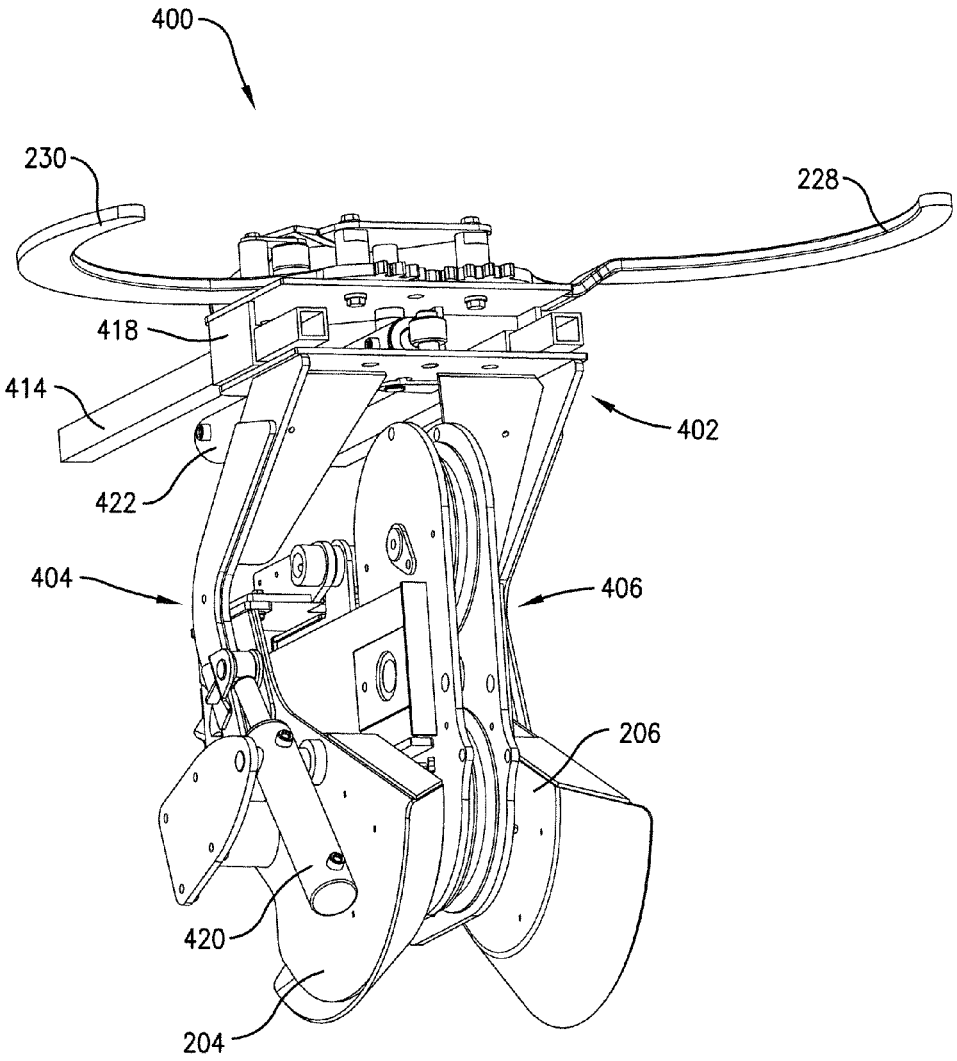
FIG. 18 is another perspective view of the load guide of FIG. 17.
Figure 19:
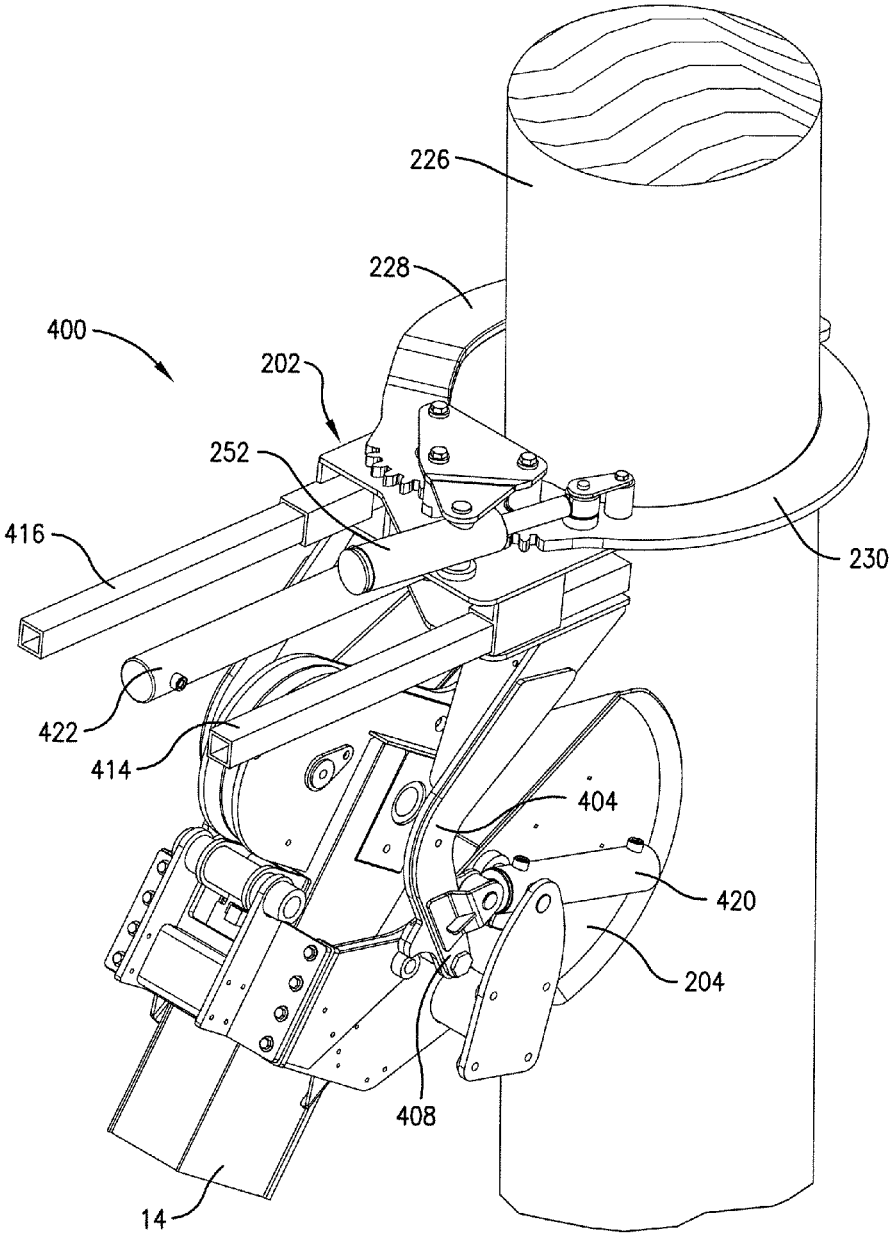
FIG. 19 is a perspective view of the load guide illustrated in FIG. 16 illustrated engaging a load.

In operation, the arm assembly 202 is placed in the stowed position when not in use, wherein the arm assembly 202 is moved toward the end of the rails 414,416 opposite the track assembly base 412, and the arms 228,230 are placed in a closed position, as illustrated in FIG. 16. In this position the arm assembly 202 is on an opposite side of the boom 14 from the load and does not extend beyond the boom tip, such that it minimizes interference with operation of the boom 14. When the load guide 400 is positioned to engage the load 226, the second actuator 420 operates to move the arm assembly 202 forward along the rails 414,416 toward the track assembly base 412, and the first actuator 420 operates to rotate the arms 228,230 from the closed position to the open position, as illustrated in FIGS. 17 and 18. The second actuator 420 operates to rotate the track assembly 402 and arm assembly 202 forward relative to the side plates 204,206 so that the arms 228,230 are positioned to grasp the load 226, wherein the first actuator 252 operates to rotate the arms from the open position to a closed position thereby grasping the load 226 as illustrated in FIG. 19 and securing the load 226 in engagement with the load guide 400.

Although the invention has been described with reference to the exemplary embodiments illustrated in the attached drawings, it is noted that equivalents may be employed and substitutions made herein without departing from the scope of the invention as recited in the claims. For example, while the arm assembly has been illustrated and described as being attached to the top plate of the load guide base, it will be appreciated that the arm assembly may alternatively be attached to the bottom plate of the base or otherwise attached to the base. Furthermore, the interlocked toothed edge portions 74,74 of the first and third link elements 58,62 represent one, exemplary method of mechanically entraining the two elements 58,62. Other methods may be used without departing from the scope of the invention including, for example, a chain and sprocket assembly.

Having thus described various embodiments of the invention, what is claimed as new and desired to be protected by Letters Patent includes the following:

1. A load guide for coupling to a boom assembly of an aerial device, the load guide comprising:

a load guide base adapted to be coupled to the boom assembly, said load guide base presenting a front portion that is proximate a load and defining a forward direction, said load guide base presenting a back portion that is opposite the front portion and defining a backward direction, a pair of load-securing arms, each of the load-securing arms being rotationally connected to a pivot point, each of the load-securing arms being movable between an operative position and a retracted position, wherein when the pair of load-securing arms is in the operative position, the load-securing arms are adapted to secure and release a load, said load-securing arms being disposed in an operational plane, wherein when the pair of load-securing arms is in the retracted position, the load-securing arms are stored such that the load-securing arms neither secure nor release a load, said load securing arms being disposed in a retracted plane, wherein the operational plane is generally coplanar with the retracted plane;

at least one link element disposed between the load guide base and the pivot point of each of the load-securing arms, each link element movably connected to the load guide base; and an actuator for inducing movement of at least one said link element relative to the base, thereby causing the pair of load-securing arms to move from the operative position to the retracted position, wherein the movement of each said link element relative to the load guide base corresponds to at least some translational movement of the pivot point of each load-securing arm in the forward direction or the backward direction, wherein moving the load-securing arms from the operative position to the retracted position includes rotating each of the load-securing arms toward the other load-securing arm about their respective pivot points, and further includes at least some translational movement of the pivot point of each of the load-securing arms relative to the front portion of the load guide base.

2. The boom assembly of claim 1, each of the load-securing arms including a load engaging portion, wherein when the load-securing arms are in the operative position most of the load engaging portion of each load-securing arm extends beyond the front portion of the load guide base, and when the load-securing arms are in the retracted position most of the load engaging portion of each load-securing arm is positioned behind the front portion of the load guide base.

3. The boom assembly of claim 1, wherein said at least one link element includes:

a first link element pivotably attached to the load guide base and pivotably attached to a first of the load-securing arms; and a third link element pivotably attached to the load guide base and pivotably attached to a second of the load-securing arms, the first and third link elements being mechanically entrained such that movement of one load-securing arm causes corresponding substantially symmetric movement of the other load-securing arm.

4. The boom assembly of claim 3, the first link element and the third link element each including an arcuate toothed edge portion, the arcuate toothed edge portion of the first link element being entrained with the arcuate toothed portion of the third link element.

5. The boom assembly of claim 3, the first link element being pivotably attached to an end of the first load-securing arm distal a load engaging portion of the first load-securing arm, and the third link element being pivotably attached to an end of the second load-securing arm distal a load engaging portion of the second load-securing arm.

6. The boom assembly of claim 5, wherein the at least one link element further includes:

a second link element pivotably attached to said load guide base and pivotably attached to the first load-securing arm; and a fourth link element pivotably attached to said load guide base and pivotably attached to the second load-securing arm.

7. The boom assembly of claim 6, the second link element being pivotably attached to the first load-securing arm between the first link element and the load engaging portion of the first load-securing arm, the fourth link element being pivotably attached to the second load-securing arm between the third link element and the load engaging portion of the second load-securing arm.

8. The boom assembly of claim 7, the second link element being pivotably attached to the first load-securing arm proximate the load engaging portion of the first load-securing arm, and the fourth link element being pivotably attached to the second load-securing arm proximate the load engaging portion of the second load-securing arm.

9. The boom assembly of claim 1, further comprising a hydraulic piston for actuating movement of the pair of load-securing arms relative to said load guide base, thereby causing each of the pair of load-securing arms to move from the operative position to the retracted position.

10. The boom assembly of claim 1, the front portion of the load guide base including a plurality of load engaging elements that cooperate with the pair of load-securing arms to secure the load.

11. The boom assembly of claim 1, wherein when the load-securing arms are in the retracted position, forward and outward facing portions of the arms present substantially smooth, inwardly-curved outer edges.

12. The boom assembly of claim 1, further comprising a joint connecting the load guide base and the boom and allowing the load guide base to pivot relative to the boom.

13. A load guide including a retractable arm assembly, the load guide comprising:

a base including a load engaging front portion;

a first arm and a second arm each including a mounting portion and a load engaging portion;

a first link element pivotably attached to the base proximate a first end of the first link element and pivotably attached to the mounting portion of the first arm proximate a second end of the first link element;

a second link element pivotably attached to the base proximate a first end of the second link element and pivotably attached to the first arm proximate a second end of the second link element;

a third link element pivotably attached to the base proximate a first end of the third link element and pivotably attached to the mounting portion of the second arm proximate a second end of the third link element, the first and third link elements being mechanically entrained such that movement of one causes corresponding symmetric movement of the other;

a fourth link element pivotably attached to the base proximate a first end of the fourth link element and pivotably attached to the second arm proximate a second end of the fourth link element; and an actuator for inducing movement of the third link element relative to the base, thereby causing the first arm and the second arm to move from an operative position to a retracted position, wherein moving the arms from the operative position to the retracted position includes rotating each of the arms toward the other arm, and further includes at least some translational movement of the mounting portion of each arm relative to the front portion of the base.

14. The load guide apparatus of claim 13, each of the arms including a load engaging portion, wherein when the arms are in the operative position most of the load engaging portion of each arm extends beyond a front portion of the base, and when the arms are in the retracted position most of the load engaging portion of each arm is positioned behind the front portion of the base.

15. The load guide apparatus of claim 13, the first link element being pivotably attached to an end of the first arm distal the load engaging portion of the first arm, and the third link element being pivotably attached to an end of the second arm distal the load engaging portion of the second arm.

16. The load guide apparatus of claim 13, the second link element being pivotably attached to the first arm between the first link element and the load engaging portion of the first arm, the fourth link element being pivotably attached to the second arm between the second link element and the load engaging portion of the second arm.

17. The load guide apparatus of claim 16, the second link element being pivotably attached to the first arm proximate the load engaging portion of the first arm, the fourth link element being pivotably attached to the second arm proximate the load engaging portion of the second arm.

18. The load guide apparatus of claim 13, wherein when the arms are in the retracted position, forward and outward facing portions of the arms present smooth, inwardly-curved outer edges.

19. A method of using a load guide with a retractable arm assembly, comprising:

moving a pair of load-securing arms of the arm assembly to an open position to receive a load;

moving the pair of load-securing arms to an engaged position to engage and secure the load, wherein a pivot point of each of the pair of load-securing arms is in an operative position when the pair of load-securing arms is in the open position or the engaged position; and operating an actuator to thereby move the pair of load-securing arms to a retracted position by moving each of the pivot points of each of the pair of arms to a rear position, wherein when the pair of load-securing arms is in the operative position, the load-securing arms are adapted to secure and release a load, said load-securing arms being disposed in an operational plane, wherein when the pair of load-securing arms is in the retracted position, the load-securing arms are stored such that the load-securing arms neither secure nor release a load, said load securing arms being disposed in a retracted plane, wherein the operational plane is generally coplanar with the retracted plane.

20. The method of claim 19, wherein moving the pair of load-securing arms to the retracted position causes at least half of a load engaging portion of each load-securing arm to be positioned behind a front portion of a load guide base, the load guide base being secured to a boom.

* * * * *